United States Patent [19]

Gerber

[11] Patent Number: 4,608,792

[45] Date of Patent: Sep. 2, 1986

[54] ROOF MEMBRANE HOLDOWN SYSTEM

[75] Inventor: Dennis H. Gerber, Los Gatos, Calif.

[73] Assignee: Burke Industries, Inc., San Jose, Calif.

[21] Appl. No.: 660,436

[22] Filed: Oct. 12, 1984

[51] Int. Cl.[4] ..... E04F 17/04; E04D 13/16

[52] U.S. Cl. ..... 52/199; 52/1; 98/34

[58] Field of Search ..... 52/199, 1; 98/32, 34, 98/42

[56] References Cited

U.S. PATENT DOCUMENTS

| | | | |
|---|---|---|---|
| 1,451,884 | 4/1923 | Moen | 98/34 |
| 1,965,158 | 7/1934 | Rogliano | 98/34 |
| 3,267,833 | 8/1966 | Artis et al. . | |
| 4,221,096 | 9/1980 | Viertlboeck | 52/199 X |
| 4,223,486 | 9/1980 | Kelly | 52/173 R |
| 4,228,729 | 10/1980 | Messick | 52/199 X |
| 4,409,761 | 10/1983 | Bechtel | 52/199 X |
| 4,490,952 | 1/1985 | Winston | 52/199 |

FOREIGN PATENT DOCUMENTS

| | | | |
|---|---|---|---|
| 615327 | 2/1961 | Canada | 52/199 |
| 2060500 | 6/1972 | Fed. Rep. of Germany . | |
| 2408794 | 7/1979 | France . | |
| 1315334 | 5/1973 | United Kingdom | 52/199 |

*Primary Examiner*—J. Karl Bell

*Attorney, Agent, or Firm*—James R. Cypher

[57] ABSTRACT

A roof system which includes a generally moisture and gas impervious membrane connected to the roof structure at its perimeter. A suction device driven by the wind or electrical motors or a combination of both creates a suction between the membrane and the roof substrate which causes the membrane to be held closely to the roof substrate. The wind driven suction devices increase the suction between the membrane and roof substrate in direct proportion to the velocity of the wind crossing the roof area.

8 Claims, 3 Drawing Figures

ROOF MEMBRANE HOLDOWN SYSTEM

BACKGROUND OF THE INVENTION

Sheets of waterproof membranes made of rubber or plastic have been used for several years to line ponds and to cover the water in some water reservoirs. The use of similar sheets of material have been used in roofing systems, particularly structures having large roof areas. The membranes have been attached to the roof structure by adhesives covering the entire membrane or other systems adhere the membrane only to selected spot connections. When the entire membrane is adhered to the roof structure, normal expansion and construction in the roof sets up stresses in the membrane which ultimately results in failure along the stress lines. Where the membrane is attached at localized areas, stress is caused at the localized areas due to the wind lifting and shifting the membrane with respect to the roof.

Others have secured the membrane to the roof by placing weighting materials on top of the membrane such as a layer of gravel. While this system satisfactorily holds the membrane to the roof, the weighting materials adds considerable weight to the structure which requires that all structural elements be stronger thereby adding to the cost of the structure.

SUMMARY OF THE INVENTION

The roof system disclosed in this application in its basic form eliminates the need for weighting materials. A wind driven device creates a suction between the roof substrate and the membrane when wind flows across the roof structure. As wind velocity increases requiring greater forces to hold the membrane to the roof structure, the wind driven device automatically provides greater suction and greater holding power.

The suction is applied evenly to substantially the entire membrane by providing gas flow passages on the underside of the membrane; on the upper surface of the roof substrate, or by supplying a separate porous member between the roof substrate and the membrane.

No energy is expended in addition to the naturally occurring wind force and no wear occurs in the apparatus when there is no wind force which would cause uplift in the membrane. In some situations where greater suction is required than is provided by wind power, motor driven fans may be mounted in the system to supplement the wind powered suction systems.

Figure 1:
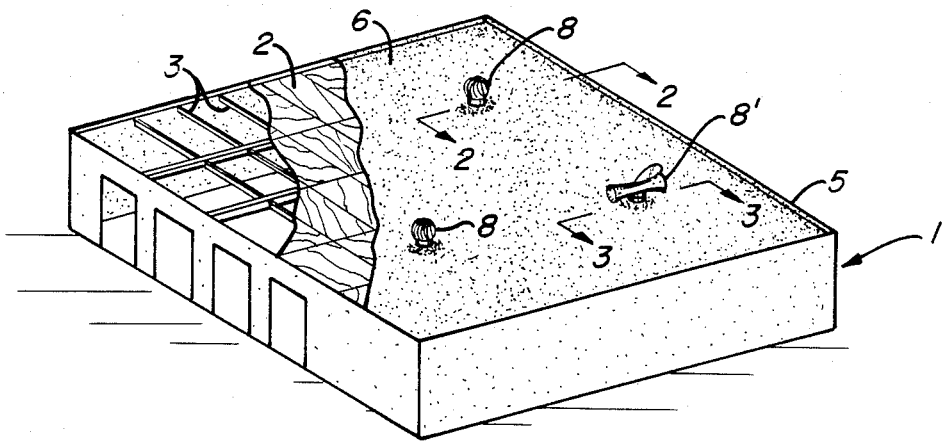
FIG. 1 is a perspective view of a building roof including a wind driven turbine.
Figure 2:
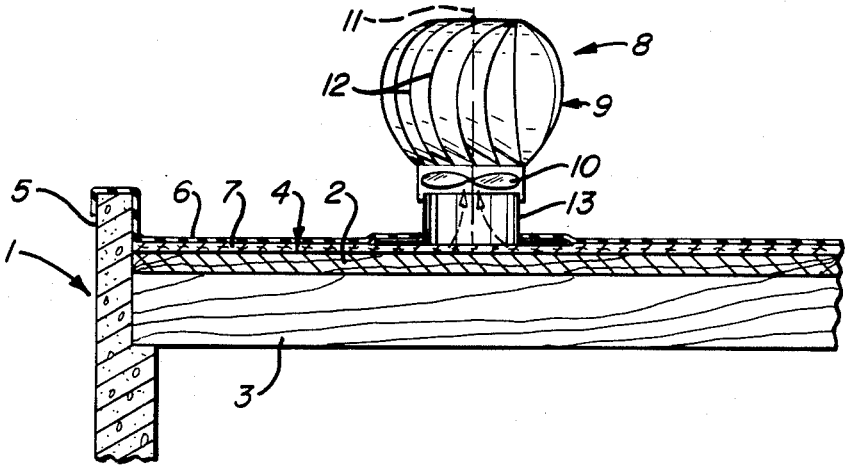
FIG. 2 is a cross sectional view taken along line 2—2 of FIG. 1.

DESCRIPTION OF THE PREFERRED EMBODIMENTS OF THE INVENTION:

Referring to FIGS. 1 and 2, the roof system of the present invention is illustrated overlying and supported by a roof structure such as for a large warehouse 1. One form of roof substructure which may be used is a plurality of standard plywood panels 2 which are attached to purlins which in turn rest on beams 3. A substantially gas impervious substrate covers substantially the entire roof substructure. A perimeter structure 5 surrounds the substrate. A roof membrane 6 formed of a plurality of rubber or plastic sheets joined at their edges by standard sealing means is attached to the perimeter structure. The membrane is substantially impervious to the passage of moisture and gas. Air conduit means 7 is interposed between the substrate and the roof membrane for permitting the flow of gas in the space between the substrate and the roof membrane. A suction means 8 is mounted above the roof membrane and is operably connected to the air conduit means for withdrawing air from between the roof membrane and the roof substrate. The air is discharged to the atmosphere thereby creating suction between the substrate and the membrane.

The substrate can be aqy of various systems and need not be as gas impervious as the roof membrane. It is important only that when the suction device is activated, air should not be withdrawn from the inside of the building. The withdrawal of inside air would not only make it difficult to create the necessary vacuum between the substrate and the membrane, but it would also tend to upset the heating and cooling system within the building.

The membrane may be any of various standard rubber or plastic membranes which are commercially available in large strips which may be sealed together at the seams. A membrane made from Dupont de Nemours Hypalon synthetic rubber is preferred because of its excellent weather resistant qualities, and low gas and water permeability.

The air conduit means may consist of various methods. For example, the conduit means could be formed in the roof substrate. If the membrane is placed over an existing roofing covered with small stones, air could pass freely between the stones beneath the membrane. The surface of the plywood panels could be sawn or roughened to establish the necessary air channels so air could pass from the perimeter of the roof to the suction device.

The air conduit means may also be an integral part of the underside of the roof membrane. A pattern of air channels may be molded or formed by any means in the underside of the membrane so that air may pass from all areas beneath the roof membrane to the air suction device.

Preferably, the air conduit means consists of a separate layer of material placed between the substrate and the membrane. This may be a porous material which is either plastic or fibrous. An example of a fibrous material is Crown Zellerbach Corporation's FibreTex nonwoven fiberous mat. When the air conduit means is a separate layer it should be relatively thin so that the volume of air necessary to evacuate the space between the substrate and membrane is relatively small so that the suction can be effected in a relatively short period of time to prevent billowing or shifting of the membrane during high speed but short bursts of wind across the roof.

The suction means is preferably a wind driven turbine 9 which requires no electric motors to drive the turbine. Thus, should the power fail during a storm, the wind turbine will continue to operate. While some may find the standard wind turbine such as the Artis Metals Co. rotary wind turbine or the wind turbine sold by W. W. Grainger, Inc. to be adequate, greater efficiency and greater vacuum can be attained by attaching a fan blade 10 to the vertical axis 11. As the wind strikes the air scoops 12 on one side of the turbine, the scoops and axis 11 are caused to rotate. The inside edges of the air scoops withdraw air from inside the wind turbine and force it to the atmosphere, thereby causing a suction inside the air turbine, which thus causes air in the pedestal to move up through the wind turbine. This movement of air causes the suction in the air conduit means between the substrate and the membrane. The rotation of the wind turbine can also be used to rotate the fan blade mounted in the base of the wind turbine which increases the volume of air evacuated through the wind turbine and thus causes greater suction beneath the membrane. The fan also causes the movement of a greater volume of air in a shorter time and thus the vacuum beneath the membrane is established more quickly.

It is to be understood that the fan need not be driven by the wind turbine but may be a motorized fan either placed in the conduit without a wind turbine or in conjunction with a wind turbine. The motor may be continuously driven or preferably a sensor means is provided to measure the wind velocity of the speed of the wind turbine to turn the motor on and off. When wind velocity is high, the fan is operated to create greater suction. Further, in some conditions where the wind turns the turbine at a certain minimum rotation, the fan may be turned on in the event that sudden gusts occur which would be too short to cause the necessary amount of build-up of suction below the membrane.

Figure 3:
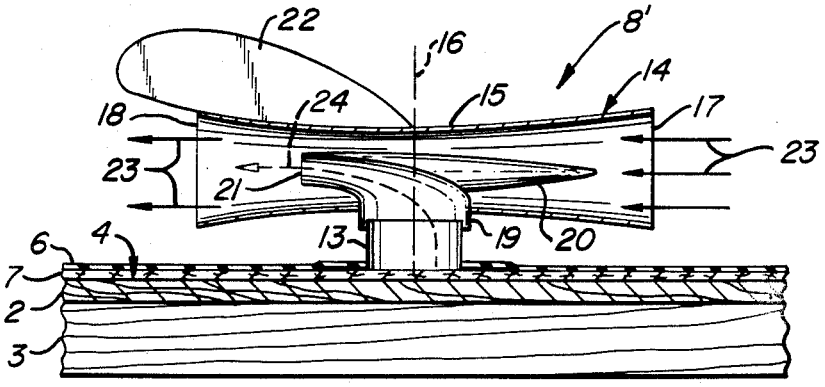
FIG. 3 is a cross sectional view illustrating another device for creating a vacuum between the roof and the sheet membrane.

Referring to FIG. 3, another form of suction means 8' is illustrated, which consists of a wind operated venturi 14. The wind driven venturi includes a generally horizontally mounted wind tube 15 which is mounted for rotation about a vertical axis 16 and is formed with an air inlet 17, an air outlet 18 and a venturi pipe 19 mounted in the throat of the wind tube. A wind constrictor 20 restricts the area of the throat of the wind tube and provides a downstream opening 21 for the venturi tube. A wind vane 22 is mounted on the wind tube for directing the air inlet opening into the wind.

As the wind enters the horizontal wind tube 15 through wind inlet 17 in the direction of arrow 23, its velocity increases as it passes through the throat area or narrowest portion of the wind tube. This causes the pressure to decrease at the down stream opening 21 and air moves in the direction of arrows 24 thus causing a suction in the substrate 7 below the membrane 6. This causes the membrane to be held in close contact with the substrate 4.

I claim:

1. A roof system overlying and supported by a roof substructure comprising:

a. a substantially gas impervious substrate having an upper surface and covering substantially said entire roof substructure;

b. a perimeter structure surrounding said substrate;

c. a roof membrane which is substantially impervious to the passage of moisture and gas having an upper and lower surface and is substantially sealably attached to said perimeter structure forming a substantially gas impervious chamber;

d. air conduit means interposed between said substrate and said roof membrane within said substantially impervious chamber for permitting the flow of gas in the space between said substrate and roof membrane; and e. suction means operably connected to said air conduit means within said substantially gas impervious chamber for withdrawing air from said air conduit means within said substantially gas impervious chamber thereby reducing the pressure between said membrane and said substrate and creating a holdown force on said membrane.

2. A roof system as described in claim 1 wherein:

a. said air conduit means is formed in said upper surface of said substrate.

3. A roof system as described in claim 1 wherein:

a. said air conduit means is formed in said lower surface of said roof membrane.

4. A roof system as described in claim 1 wherein:

a. said air conduit means consists of a porous material.

5. A roof system as described in claim 1 wherein:

a. said suction means is a wind driven rotatable turbine which exhausts air to atmosphere when driven by the wind.

6. A roof system as described in claim 5 comprising:

a. a fan mounted in said wind turbine and driven by said wind turbine for increasing the suction force between said substrate and said membrane.

7. A roof system as described in claim 1 wherein:

a. said suction means is a wind operated venturi formed with a generally horizontally mounted wind tube mounted for rotation about a vertical axis and having an air inlet, an air outlet and a venturi tube mounted in said wind tube, and a wind vane mounted on said wind tube for directing said air inlet into the wind.

8. A roof system as described in claim 1 comprising:

a. said suction means is a powered air moving device.

* * * * *